US005726007A

United States Patent [19]

Deaton et al.

[11] Patent Number: 5,726,007

[45] Date of Patent: Mar. 10, 1998

[54] LIMITED DISPERSITY EPITAXIALLY SENSITIZED ULTRATHIN TABULAR GRAIN EMULSIONS

[75] Inventors: Joseph Charles Deaton, Rochester; David Earl Fenton, Fairport; Allen Keh-Chang Tsaur, Rochester, all of N.Y.

[73] Assignee: Eastman Kodak Company, Rochester, N.Y.

[21] Appl. No.: 722,403

[22] Filed: Sep. 30, 1996

[51] Int. Cl.[6] ..... G03C 1/035; G03C 1/043

[52] U.S. Cl. ..... 430/567; 430/569; 430/637

[58] Field of Search ..... 430/567, 569, 430/637

[56] References Cited

U.S. PATENT DOCUMENTS

| | | | |
|---|---|---|---|
| 5,147,771 | 9/1992 | Tsaur et al. | 430/569 |
| 5,147,772 | 9/1992 | Tsaur et al. | 430/569 |
| 5,147,773 | 9/1992 | Tsaur et al. | 430/569 |
| 5,171,659 | 12/1992 | Tsaur et al. | 430/569 |
| 5,210,013 | 5/1993 | Tsaur et al. | 430/567 |
| 5,236,817 | 8/1993 | Kim et al. | 430/567 |
| 5,250,403 | 10/1993 | Antoniades et al. | 430/505 |
| 5,252,453 | 10/1993 | Tsaur et al. | 430/569 |
| 5,334,469 | 8/1994 | Sutton et al. | 430/21 |
| 5,494,789 | 2/1996 | Daubendiek et al. | 430/567 |
| 5,503,970 | 4/1996 | Olm et al. | 430/567 |
| 5,503,971 | 4/1996 | Daubendiek et al. | 430/567 |
| 5,536,632 | 7/1996 | Wen et al. | 430/567 |
| 5,573,902 | 11/1996 | Daubendiek et al. | 430/567 |
| 5,576,168 | 11/1996 | Daubendiek et al. | 430/567 |
| 5,576,171 | 11/1996 | Olm et al. | 430/567 |
| 5,582,965 | 12/1996 | Deaton et al. | 430/567 |

*Primary Examiner*—Mark F. Huff
*Attorney, Agent, or Firm*—Carl O. Thomas

[57] ABSTRACT

A photographic emulsion is disclosed comprised of coprecipitated radiation-sensitive silver halide grains containing greater than 70 mole percent bromide, based on silver, and exhibiting a coefficient of variation of less than 30 percent. Greater than 90 percent of total projected area of the grains is accounted for by tabular grains having {111} major faces, exhibiting a thickness of less than 0.07 μm, and having latent image forming silver salt epitaxy chemical sensitization sites on their surfaces, and a dispersing medium that contains a grain dispersity reducing concentration of a polyalkylene oxide block copolymer surfactant comprised of two terminal lipophilic alkylene oxide block units linked by a hydrophilic alkylene oxide block unit accounting for from 4 to 96 percent of the molecular weight of the polymer. The emulsions offer unexpectedly low levels of minimum density and can be more easily manufactured as compared to conventional ultrathin tabular grain emulsions with comparably limited grain dispersity.

12 Claims, No Drawings

LIMITED DISPERSITY EPITAXIALLY SENSITIZED ULTRATHIN TABULAR GRAIN EMULSIONS

FIELD OF THE INVENTION

The invention relates to photography. More specifically, the invention relates to radiation-sensitive silver halide emulsions for use in photographic imaging.

DEFINITION OF TERMS

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "ultrathin" in referring to tabular grains and tabular grain emulsions indicates that the tabular grains have a mean thickness of less than 0.07 μm.

The term "coefficient of variation" or "COV" is defined as 100 times the standard deviation of grain ECD divided by mean ECD and is expressed as a percentage.

The term "high bromide" in referring to grains and emulsions indicates that bromide is present in concentrations of greater than 70 mole percent, based on total silver.

In referring to grains and emulsions containing two or more halides, the halides are named in order of ascending concentrations.

The term "{111} tabular" is employed in to indicate tabular grains and tabular grain emulsions in which the tabular grains have {111} major faces.

*Research Disclosure* is published by Kenneth Mason Publications, Ltd., Dudley House, 12 North St., Emsworth, Hampshire P010 7DQ, England.

BACKGROUND

Antoniades et al U.S. Pat. No. 5,250,403 was the first to select ultrathin tabular grain emulsions based on a recognition of their superior performance properties. When optimally spectrally sensitized ultrathin tabular grain emulsions absorb larger amounts of minus blue (i.e., green and/or red) light than thicker tabular grain emulsions. In the minus blue region of the spectrum ultrathin tabular grain emulsions provide superior speed-granularity relationships. In black-and-white imaging ultrathin tabular grain emulsions offer increased covering power. In photographic element constructions that contain two or more superimposed radiation-sensitive emulsion layers, such as multicolor photographic elements, ultrathin tabular grain emulsions allow sharper images to be obtained. Additionally, ultrathin tabular grain emulsions are advantageous in that spectral reflectance is less varied as a function of wavelength (see Sutton et al U.S. Pat. No. 5,334,469 for a more detailed discussion).

Antoniades et al was able to produce ultrathin tabular grain emulsions with low levels of grain dispersity. Antoniades et al reports example emulsions with COV values of 20 and 15 percent. Unfortunately, the processes by which Antoniades et al prepared ultrathin tabular grain emulsions have not proven attractive. Specifically, Antoniades et al employs a relatively complicated procedure for emulsion preparation in which grain nuclei are formed in one reaction vessel and then transferred to a second reaction vessel in which tabular grain growth occurs. This entails the complexity of simultaneously monitoring and controlling two reaction vessels during ultrathin tabular grain emulsion precipitation.

Advantageous properties for epitaxially sensitized ultrathin tabular grain emulsions are demonstrated by the following:

(1) Daubendiek et al U.S. Pat. No. 5,494,789;

(2) Olm et al U.S. Pat. No. 5,503,970;

(3) Daubendiek et al U.S. Pat. No. 5,503,971;

(4) Wen et al U.S. Pat. No. 5,536,632;

(5) Daubendiek et al U.S. Pat. No. 5,576,168

(6) Wilson et al U.S. Pat. No. 5,614,358; and (7) Deaton et al U.S. Pat. No. 5,582,965.

In each of (1)–(7), referred to collectively as the ultrathin/epitaxy citations, the preparation of low COV ultrathin tabular grain emulsions by the techniques of Antoniades et al was specifically recognized. However, in the actual examples reported other, preferred procedures were employed for tabular grain preparation that resulted in reported COV values in excess of 30 percent.

Tsaur et al U.S. Pat. No. 5,210,013 discloses high bromide {111} tabular grain emulsions having a COV of less than 10 percent. The tabular grains are formed in the presence of selected polyalkylene oxide block copolymer surfactants containing hydrophilic and lipophilic alkylene oxide block units. The polyalkylene oxide block copolymer allows substantially all (>97%) of total grain projected area to be accounted by tabular grains. Other illustrations of high bromide {111} tabular grain emulsions similarly prepared, but with COV values ranging above 10 percent, but in all instances <30 percent, are illustrated Tsaur et al U.S. Pat. Nos. 5,147,771, 5,147,772, 5,147,773, 5,171,659 and 5,252,453. All of the Tsaur et al patents in this paragraph are hereinafter collectively referred to as Tsaur et al.

Although the polyalkylene oxide block copolymer allows low levels of grain dispersity to be realized, this advantage is offset by thickening of the tabular grains. Tsaur et al discloses mean tabular grain thicknesses range from 0.08 to 0.3 μm.

Daubendiek et al U.S. Pat. No. 5,573,902 and Olm et al U.S. Pat. No. 5,576,171 teach the epitaxial sensitization of tabular grain emulsions with mean thicknesses in the range of from 0.07 to 0.3 μm. Daubendiek et al '902 and Olm et al '171 differ from the ultrathin/epitaxy citations in citing Tsaur et al for teachings of preparation of suitable host tabular grain emulsions.

RELATED PATENT APPLICATION

Tsaur U.S. Ser. No. 08/724,716, filed concurrently herewith and commonly assigned, titled LOW DISPERSITY ULTRATHIN TABULAR GRAIN EMULSION, discloses a modification of the emulsion preparation process of Tsaur et al U.S. Pat. No. 5,147,771 that results in ultrathin tabular grain emulsions.

SUMMARY OF THE INVENTION

It has been discovered quite unexpectedly that epitaxially sensitized ultrathin tabular grain emulsions having a coefficient of variation of mean grain size (ECD) of less than 30 percent prepared in the presence of a selected class of polyalkylene oxide block copolymers exhibit lower levels of minimum density than have been realized heretofore for emulsions of comparable grain dimensions and dispersity.

It has been realized additionally that these emulsions are advantageous in that they can be prepared by simpler procedures than have heretofore been employed to prepare emulsions of comparable grain dimensions and dispersity.

In one aspect this invention is directed to a photographic emulsion comprised of coprecipitated radiation-sensitive silver halide grains containing greater than 70 mole percent bromide, based on silver, and a dispersing medium wherein (a) the coprecipitated radiation-sensitive grains exhibit a coefficient of variation of less than 30 percent, (b) greater than 90 percent of total projected area of the coprecipitated radiation-sensitive silver halide is accounted for by grains which are tabular (1) having {111} major faces, (2) exhibiting a thickness of less than 0.07 μm, and (3) having latent image forming chemical sensitization sites on the surfaces of the tabular grains, the chemical sensitization sites including at least one silver salt epitaxially located on the tabular grains, and (c) the dispersing medium contains a grain dispersity reducing concentration of a polyalkylene oxide block copolymer surfactant comprised of two terminal lipophilic alkylene oxide block units linked by a hydrophilic alkylene oxide block unit accounting for from 4 to 96 percent of the molecular weight of the polymer.

DESCRIPTION OF PREFERRED EMBODIMENTS

The emulsions of the invention are prepared by first preparing a limited grain size dispersity (low COV) ultrathin tabular grain emulsion and then chemically sensitizing the emulsion by depositing silver salt epitaxy on the tabular grains. The emulsions can be thereafter prepared for various selected photographic uses in any convenient conventional manner.

(a) The Ultrathin Tabular Host Grains

It is contemplated to prepare for subsequent epitaxial sensitization a tabular grain emulsion comprised of coprecipitated radiation-sensitive silver halide grains containing greater than 70 mole percent bromide, based on silver, and a dispersing medium. The coprecipitated radiation-sensitive grains exhibit a coefficient of variation of less than 30 percent, and tabular grains account for greater than 90 percent of total projected area. The tabular grains have {111} major faces and exhibit a mean thickness of less than 0.07 μm. The dispersing medium contains a grain dispersity reducing concentration of a polyalkylene oxide block copolymer surfactant comprised of two terminal lipophilic alkylene oxide block units linked by a hydrophilic alkylene oxide block unit accounting for from 4 to 96 percent of the molecular weight of the polymer.

The ultrathin tabular host grain emulsions, summarized above, have been realized by a combination of modifications of the post nucleation solvent ripening process for preparing tabular grain emulsions taught by Tsaur et al. The process employed to prepare the ultrathin tabular host grain emulsions maintains low levels of grain size dispersity of the silver halide grains of the emulsion while also limiting the mean thickness of the tabular grains to <0.07 μm.

In conventional post nucleation solvent ripening processes for preparing tabular grain emulsions, used by both Antoniades et al and Tsaur et al, cited above, the first step is to form a population of silver halide grain nuclei containing parallel twin planes. A silver halide solvent is next used to ripen out a portion of the silver halide grain nuclei, and the silver halide grain nuclei containing parallel twin planes not ripened out are then grown to form tabular silver halide grains.

To achieve low grain size dispersities (that is, COV's of less than 30%, preferably less than 25%) and ultrathin tabular grains, the first step is to undertake formation of the silver halide grain nuclei under conditions that promote uniformity. Prior to forming the grain nuclei bromide ion is added to the dispersing medium. Although other halides can be added to the dispersing medium along with silver, prior to introducing silver, halide ions in the dispersing medium consist essentially of bromide ions.

The balanced double jet precipitation of grain nuclei is specifically contemplated in which an aqueous silver salt solution and an aqueous bromide salt are concurrently introduced into a dispersing medium containing water and a hydrophilic colloid peptizer. Prior to introducing the silver salt a small amount of bromide salt is added to the reaction vessel to establish a slight stoichiometric excess of halide ion. One or both of chloride and iodide salts can be introduced through the bromide jet or as a separate aqueous solution through a separate jet. It is preferred to limit the concentration of chloride and/or iodide to about 20 mole percent, based on silver, most preferably these other halides are present in concentrations of less than 10 mole percent (optimally less than 6 mole percent) based on silver. Silver nitrate is the most commonly utilized silver salt while the halide salts most commonly employed are ammonium halides and alkali metal (e.g., lithium, sodium or potassium) halides. The ammonium counter ion does not function as a ripening agent since the dispersing medium is at an acid pH—i.e., less than 7.0.

The present invention achieves low grain dispersity and realizes ultrathin tabular grains by producing prior to ripening a population of parallel twin plane containing grain nuclei in the presence of a selected surfactant. Specifically, it has been discovered that the dispersity of the tabular grain emulsion can be reduced by introducing parallel twin planes in the grain nuclei in the presence of a polyalkylene oxide block copolymer surfactant comprised of two terminal lipophilic alkylene oxide block units linked by a hydrophilic alkylene oxide block unit accounting for at least 4 percent of the molecular weight of the copolymer.

Polyalkylene oxide block copolymer surfactants generally and those contemplated for use in the practice of this invention in particular are well known and have been widely used for a variety of purposes. They are generally recognized to constitute a major category of nonionic surfactants. For a molecule to function as a surfactant it must contain at least one hydrophilic unit and at least one lipophilic unit linked together. A general review of block copolymer surfactants is provided by I. R. Schmolka, "A Review of Block Polymer Surfactants", J. Am. Oil Chem. Soc., Vol. 54, No. 3, 1977, pp. 110–116, and A. S. Davidsohn and B. Milwidsky, *Synthetic Detergents*, John Wiley & Sons, N.Y. 1987, pp. 29–40, and particularly pp. 34–36, the disclosures of which are here incorporated by reference.

The polyalkylene oxide block copolymer surfactants employed in the practice of this invention contain at least two terminal lipophilic alkylene oxide block units linked by a hydrophilic alkylene oxide block unit and can be, in a simple form, schematically represented as indicated by diagram I below:

| | | |
|---|---|---|
| LAO | HAO | LAO |

(I)

where

LAO in each occurrence represents a terminal lipophilic alkylene oxide block unit and HAO represents a linking hydrophilic alkylene oxide block unit.

Generally each of LAO and HAO contain a single alkylene oxide repeating unit selected to impart the desired hydrophilic or lipophilic quality to the block unit in which it is contained. Hydrophilic-lipophilic balances (HLB's) of commercially available surfactants are generally available and can be consulted in selecting suitable surfactants. Typically HAO is chosen so that the hydrophilic block unit constitutes from 4 to 96 percent of the block copolymer on a total weight basis.

In their simplest possible form the polyalkylene oxide block copolymer surfactants are formed by first condensing ethylene glycol and ethylene oxide to form an oligomeric or polymeric block repeating unit that serves as the hydrophilic block unit and then completing the reaction using 1,2-propylene oxide. The propylene oxide adds to each end of the ethylene oxide block unit. At least six 1,2-propylene oxide repeating units are required to produce a lipophilic block repeating unit. The resulting polyalkylene oxide block copolymer surfactant can be represented by formula II:

$$HO-(\overset{\overset{CH_3}{|}}{CH}CH_2O)_x-(CH_2CH_2O)_y-(CH_2\overset{\overset{CH3}{|}}{C}HO)_{x'}-H \quad \text{(II)}$$

where x and x' are each at least 6 and can range up to 120 or more and y is chosen so that the ethylene oxide block unit maintains the necessary balance of lipophilic and hydrophilic qualities necessary to retain surfactant activity. This balance is achieved when y is chosen so that the hydrophilic block unit constitutes from 4 to 96 percent by weight of the total block copolymer. Within the above ranges for x and x', y can range from 2 to 300 or more.

While commercial surfactant manufacturers have in the overwhelming majority of products selected 1,2-propylene oxide and ethylene oxide repeating units for forming lipophilic and hydrophilic block units of nonionic block copolymer surfactants on a cost basis, it is recognized that other alkylene oxide repeating units can, if desired, be substituted, provided the intended lipophilic and hydrophilic properties are retained. For example, the 1,2-propylene oxide repeating unit is only one of a family of repeating units that can be illustrated by formula III:

$$-(\overset{\overset{R}{|}}{C}HCH_2O)- \quad \text{(III)}$$

where

R is a lipophilic group, such as a hydrocarbon—e.g., alkyl of from 1 to 10 carbon atoms or aryl of from 6 to 10 carbon atoms, such as phenyl or naphthyl.

In the same manner, the ethylene oxide repeating unit is only one of a family of repeating units that can be illustrated by formula IV:

$$-(\overset{\overset{R^1}{|}}{C}HCH_2O)- \quad \text{(IV)}$$

where $R^1$ is hydrogen or a hydrophilic group, such as a hydrocarbon group of the type forming R above additionally having one or more polar substituents—e.g., one, two, three or more hydroxy and/or carboxy groups.

Generally any such block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of less than about 16,000, preferably less than about 10,000, are contemplated for use.

Only very low levels of surfactant are required in the emulsion at the time parallel twin planes are being introduced in the grain nuclei to reduce the grain dispersity of the emulsion being formed. Surfactant weight concentrations are contemplated as low as 0.1 percent, based on the interim weight of silver—that is, the weight of silver present in the emulsion while twin planes are being introduced in the grain nuclei. A preferred minimum surfactant concentration is 1 percent, based on the interim weight of silver.

Whereas Tsaur et al teaches a broad range of surfactant concentrations to be effective, ranging up to 10 times the interim weight of silver, to realize ultrathin tabular grains it is specifically contemplated to limit the weight of the surfactant present during grain nucleation to less than the weight of silver forming the silver halide grain nuclei. Preferably, the surfactant amounts to less than 50 grams per mole of silver present during grain nucleation. It is, of course, recognized that larger amounts of surfactant can be added later in the preparation process while maintaining ultrathin tabular grains.

The invention is compatible with either of the two most common techniques for introducing parallel twin planes into grain nuclei. The preferred and most common of these techniques is to form the grain nuclei population that will be ultimately grown into tabular grains while concurrently introducing parallel twin planes in the same precipitation step. In other words, grain nucleation occurs under conditions that are conducive to twinning. The second approach is to form a stable grain nuclei population and then adjust the pAg of the interim emulsion to a level conducive to twinning.

Regardless of which approach is employed, it is advantageous to introduce the twin planes in the grain nuclei at an early stage of precipitation. It is contemplated to obtain a grain nuclei population containing parallel twin planes using less than 2 percent of the total silver used to form the tabular grain emulsion. It is usually convenient to use at least 0.05 percent of the total silver to form the parallel twin plane containing grain nuclei population, although this can be accomplished using even less of the total silver. The longer introduction of parallel twin planes is delayed after forming a stable grain nuclei population the greater is the tendency toward increased grain dispersity.

At the stage of introducing parallel twin planes in the grain nuclei, either during initial formation of the grain nuclei or immediately thereafter, the lowest attainable levels of grain dispersity and thickness in the completed emulsion are achieved by control of the dispersing medium.

The pAg of the dispersing medium is maintained in the range of from 5.4 to 10.3. Lower pAg values reduce tabular grain thickness while higher pAg values reduce grain dispersity. Thus, a preferred pAg range for both ultrathin tabular grains and low COV values is from about 7.0 to 10.0. Any convenient conventional technique for monitoring and regulating pAg can be employed.

Reductions in grain dispersities have also been observed as a function of the pH of the dispersing medium. Both the incidence of nontabular grains and the thickness dispersities of the tabular grain population have been observed to decrease when the pH of the dispersing medium is less than 6.0 at the time parallel twin planes are being introduced into the grain nuclei. The pH of the dispersing medium can be regulated in any convenient conventional manner. A strong mineral acid, such as nitric acid, can be used for this purpose.

Grain nucleation and growth occurs in a dispersing medium comprised of water, dissolved salts and a conventional peptizer. Hydrophilic colloid peptizers such as gelatin and gelatin derivatives are specifically contemplated. To realize both ultrathin tabular grains and low levels of grain size dispersity peptizer concentrations of at least 100 (preferably 300) and up to 2000 (preferably 500) grams per mole of silver introduced during the nucleation step are contemplated.

It has been observed that for ultrathin tabular grains to be obtained it is necessary to limit the formation of grain nuclei containing parallel twin planes to temperatures well below those most typically employed. Specifically, it is contemplated to limit temperatures during this step to the range of from 20° to 40° C.

Once a population of grain nuclei containing parallel twin planes has been established as described above, the next step is to reduce the dispersity of the grain nuclei population. This is conventionally achieved by either employing a ripening agent, typically ammonia or thioethers, as taught by Tsaur et al, Himmelwright U.S. Pat. No. 4,477,565 and Nottorf U.S. Pat. No. 4,722,886, or by adjusting pH to a level above 9.0 with an alkali hydroxide, as taught by Buntaine et al U.S. Pat. No. 5,013,641. To reduce grain size dispersity without thickening the tabular grains to mean thicknesses of 0.07 μm or more in the final emulsion, the ripening step is performed as taught by the patents cited above in this paragraph, the disclosures of which are here incorporated by reference, but without raising pH above 9.0 and without adding a ripening agent. Beneficial Ostwald ripening that achieves grain size dispersity reduction still occurs, but at a slower rate that does not jeopardize obtaining ultrathin tabular grains.

Once nucleation and ripening have been completed, further growth of the emulsions can be undertaken in any conventional manner consistent with achieving desired final mean grain thicknesses and ECD's. The halides introduced during grain growth can be selected independently of the halide selections for nucleation. The tabular grain emulsion can contain grains of either uniform or nonuniform silver halide composition. Although the formation of grain nuclei incorporates bromide ion and only minor amounts of chloride and/or iodide ion, the low dispersity tabular grain emulsions produced at the completion of the growth step can contain in addition to bromide ions any one or combination of iodide and chloride ions in any proportions found in tabular grain emulsions.

Internal doping of the tabular grains, such as with group VIII metal ions or coordination complexes, conventionally undertaken to obtain improved photographic properties are specifically contemplated. For optimum levels of dispersity it is, however, preferred to defer doping until after the grain nuclei containing parallel twin planes have been obtained. The shallow electron trap (SET) dopants disclosed by Daubendiek et al U.S. Pat. No. 5,494,789 are specifically contemplated as well as iridium dopants chosen to reduce reciprocity failure. Grain dopants to provide various performance modifying effects are illustrated by *Research Disclosure*, Vol. 389, September 1996, Item 38957, Section I. Emulsion grains and their preparation, D. Grain modifying conditions and adjustments, paragraph (3).

While any conventional hydrophilic colloid peptizer can be employed in the practice of this invention, it is preferred to employ gelatino-peptizers during precipitation. Gelatino-peptizers are commonly divided into so-called "regular" gelatino-peptizers and so-called "oxidized" gelatino-peptizers. Regular gelatino-peptizers are those that contain naturally occurring amounts of methionine of at least 30 micromoles of methionine per gram and usually considerably higher concentrations. The term oxidized gelatino-peptizer refers to gelatino-peptizers that contain less than 30 micromoles of methionine per gram. A regular gelatino-peptizer is converted to an oxidized gelatino-peptizer when treated with a strong oxidizing agent, such as taught by Maskasky U.S. Pat. No. 4,713,323 and King et al U.S. Pat. No. 4,942,120, the disclosures of which are here incorporated by reference. The oxidizing agent attacks the divalent sulfur atom of the methionine moiety, converting it to a tetravalent or, preferably, hexavalent form. While methionine concentrations of less than 30 micromoles per gram have been found to provide oxidized gelatino-peptizer performance characteristics, it is preferred to reduce methionine concentrations to less than 12 micromoles per gram. Any efficient oxidation will generally reduce methionine to less than detectable levels. Since gelatin in rare instances naturally contains low levels of methionine, it is recognized that the terms "regular" and "oxidized" are used for convenience of expression while the true distinguishing feature is methionine level rather than whether or not an oxidation step has been performed.

When an oxidized gelatino-peptizer is employed, it is preferred to maintain a pH during twin plane formation of less than 5.5 to achieve a minimum COV. When a regular gelatino-peptizer is employed, the pH during twin plane formation is maintained at less than 3.0 to achieve a minimum COV.

When regular gelatin is employed prior to the post-ripening grain growth, the surfactant is selected so that the hydrophilic block (e.g., HAO) accounts for 4 to 96 (preferably 5 to 85 and optimally 10 to 80) percent of the total surfactant molecular weight. It is preferred that x and x' be at least 6 and that the minimum molecular weight of the surfactant be at least 760 and optimally at least 1000. The concentration levels of surfactant are preferably restricted as iodide levels are increased.

When oxidized gelatino-peptizer is employed prior to the post-ripening grain growth, no iodide is added during the post-ripening grain growth step and the hydrophilic block (e.g., HAO) accounts for 4 to 50 (optimally 10 to 40) percent of the total surfactant molecular weight. The minimum molecular weight of the surfactant continues to be determined by the minimum values of x and x' of 6. In optimized forms x and x' are at least 7, and the minimum molecular weight of the surfactant is 760 preferably 1000.

The silver halide grain population prepared by the precipitation processes described above contain greater than 70 mole percent bromide, based on silver. Silver bromide, silver iodobromide, silver chlorobromide, silver chloroiodobromide and silver iodochlorobromide emulsions are specifically contemplated. Iodide incorporation increases photographic sensitivity and can be used in multicolor photographic elements to provide favorable interimage effects. With iodide levels as low as 0.1 (typically at least 0.5) mole percent, based on silver, result in enhanced sensitivity. Higher levels of iodide reduce the rates of development and fixing. In photography iodide levels in excess of 15 mole percent, based on silver, are uncommon, with iodide concentrations of less than 10 mole percent, based on silver, being typical. In applications requiring rapid access processing, such as radiography, iodide concentrations are limited to 3 mole percent or less, based silver. Chloride concentrations are preferably limited to less than 10 mole percent.

In all instances the tabular grains prepared by the processes described above account for greater than 90 percent of total grain projected area. It is recognized that substantially all of the grains precipitated can be tabular-that is, greater than 97 percent of the total grain projected area can be accounted for by tabular grains. Image sharpness increases progressively as the percentage of total grain projected area accounted for by tabular grains increases. It is appreciated that it is common practice to blend emulsions to modify photographic performance. Thus, the tabular grain projected area percentages stated above are specifically applied to those grain populations that are coprecipitated by the preparation processes described above.

The grains can be of any photographically useful mean ECD. Tabular grains typically range from about 0.4 to 6.0 μm in mean ECD, most typically from about 1.0 to 5.0 μm.

Although the dispersity of the tabular grains is discussed above in terms of the coefficient of variation of grain ECD's, it is appreciated that the emulsion precipitation processes described above can also produce low levels of variation between tabular grain thicknesses.

(b) Sensitization

The techniques for chemical and spectral sensitization contemplated are, except for the unexpected and favorable modifications imparted by the presence of the polyalkylene oxide block copolymer introduced during grain nucleation, those disclosed by the following patents and allowed patent applications, the disclosures of which are here incorporated by reference:

Daubendiek et al U.S. Pat. No. 5,494,789;

Olm et al U.S. Pat. No. 5,503,970;

Daubendiek et al U.S. Pat. No. 5,503,971;

Wen et al U.S. Pat. No. 5,536,632;

Daubendiek et al U.S. Pat. No. 5,576,186; and

Deaton et al U.S. Pat. No. 5,582,965.

Subject to modifications specifically described below, these preferred techniques for chemical and spectral sensitization are those described by Maskasky U.S. Pat. No. 4,435,501 (hereinafter referred to as Maskasky I), here incorporated by reference. Maskasky I reports improvements in sensitization by epitaxially depositing silver salt at selected sites on the surfaces of the host tabular grains. Maskasky I attributes the speed increases observed to restricting silver salt epitaxy deposition to a small fraction of the host tabular grain surface area. Specifically, Maskasky I teaches to restrict silver salt epitaxy to less than 25 percent, preferably less than 10 percent, and optimally less than 5 percent of the host grain surface area. Although the observations of this invention in general corroborate increasing photographic sensitivity as the percentage of host tabular grain surface area occupied by epitaxy is restricted, silver salt epitaxy has been found to be advantageous even when its location on the host tabular grains is not significantly restricted. This is corroborated by the teachings of Chen et al published European patent application 0 498 302, here incorporated by reference, which discloses high solubility silver halide protrusions on silver halide host tabular grains occupying up to 100 percent of the host tabular grain surface area. Therefore, in the practice of this invention restriction of the percentage of host tabular grain surface area occupied by silver salt epitaxy is viewed as a preference rather than a requirement of the invention. However, it is preferred that the silver salt epitaxy occupy less than 50 percent of the host tabular grain surface area.

Like Maskasky I, nominal amounts of silver salt epitaxy (as low as 0.05 mole percent, based on total silver, where total silver includes that in the host and epitaxy) are effective in the practice of the invention. Because of the increased host tabular grain surface area coverages by silver salt epitaxy discussed above and the lower amounts of silver in ultrathin tabular grains, an even higher percentage of the total silver can be present in the silver salt epitaxy. However, in the absence of any clear advantage to be gained by increasing the proportion of silver salt epitaxy, it is preferred that the silver salt epitaxy be limited to 50 percent of total silver. Generally silver salt epitaxy concentrations of from 0.3 to 25 mole percent are preferred, with concentrations of from about 0.5 to 15 mole percent being generally optimum for sensitization.

Maskasky I teaches various techniques for restricting the surface area coverage of the host tabular grains by silver salt epitaxy that can be applied in forming the emulsions of this invention. Maskasky I teaches employing spectral sensitizing dyes that are in their aggregated form of adsorption to the tabular grain surfaces capable of direct silver salt epitaxy to the edges or corners of the tabular grains. Cyanine dyes that are adsorbed to host ultrathin tabular grain surfaces in their J-aggregated form constitute a specifically preferred class of site directors. Maskasky I also teaches to employ non-dye adsorbed site directors, such as aminoazaindenes (e.g., adenine) to direct epitaxy to the edges or corners of the tabular grains. In still another form Maskasky I relies on overall iodide levels within the host tabular grains of at least 8 mole percent to direct epitaxy to the edges or corners of the tabular grains. In yet another form Maskasky I adsorbs low levels of iodide to the surfaces of the host tabular grains to direct epitaxy to the edges and/or corners of the grains. The above site directing techniques are mutually compatible and are in specifically preferred forms of the invention employed in combination. For example, iodide in the host grains, even though it does not reach the 8 mole percent level that will permit it alone to direct epitaxy to the edges or corners of the host tabular grains can nevertheless work with adsorbed surface site director(s) (e.g., spectral sensitizing dye and/or adsorbed iodide) in siting the epitaxy.

To avoid structural degradation of high bromide tabular grains Maskasky I employed silver chloride as a preferred silver salt for epitaxial deposition. Stated more generally, Maskasky I preferred that the silver salt epitaxy be of a composition that exhibits a higher overall solubility than the overall solubility of the silver halide or halides forming the host tabular grains. The overall solubility of mixed silver halides is the mole fraction weighted average of the solubilities of the individual silver halides. These composition choices are fully compatible with the practice of this invention.

However, it is preferred that the high bromide ultrathin host grains receive as silver halide epitaxy a combination of chloride and iodide. The chloride ion composition of the epitaxy, based on silver, is at least 10 mole percent higher than that of the host tabular grains, and the iodide content of the epitaxy is preferably higher (preferably at least 1 mole percent higher) than that of the host tabular grains, but limited to that compatible with a face centered cubic rock salt crystal lattice structure.

Since iodide ions are much larger than chloride ions, it is recognized in the art that iodide ions can only be incorporated into the face centered cubic crystal lattice structures formed by silver chloride and/or bromide to a limited extent. This is discussed, for example, in Maskasky U.S. Pat. Nos. 5,238,804 and 5,288,603 (hereinafter referred to as Maskasky II and III). Precipitation at ambient pressure, which is universally practiced in the art, limits iodide inclusion in a silver chloride crystal lattice to less than 13 mole percent. For example, introducing silver along with an 84:16 chloride:iodide molar ratio during silver halide epitaxial deposition resulted in an iodide concentration in the epitaxial protrusions of less than 2 mole percent, based on silver in the protrusions. By displacing a portion of the chloride with bromide much higher levels of iodide can be introduced into the protrusions. For example, introducing silver along with a 42:42:16 chloride:bromide:iodide molar ratio during silver halide epitaxial deposition results in an iodide concentration in the epitaxial protrusions formed of 7.1 mole percent, based on silver in the protrusions. Preferred iodide ion concentrations in the protrusions are in the range of from 1 to 15 mole percent (most preferably 2 to 10 mole percent), based on silver in the protrusions. Improvements in speed-granularity relationships can be realized by introducing along with silver ions during epitaxial deposition chloride, bromide and iodide ions.

The most favorable speed-granularity relationships are realized when the silver halide epitaxy contains both (1) the large differences in chloride concentrations between the host ultrathin tabular grains and the epitaxially deposited protrusions noted above and (2) elevated levels of iodide inclusion in the face centered cubic crystal lattice structure of the protrusions. One preferred technique relevant to objective (1) is to introduce the different halide ions during precipitation of the protrusions in the order of descending solubilities of the silver halides that they form. For example, if chloride, bromide and iodide ions are all introduced during precipitation of the protrusions, it is preferred to introduce the chloride ions first, the bromide ions second and the iodide ions last. Because silver iodide is less soluble than silver bromide which is in turn less soluble than silver chloride, the sequential order of halide ion addition preferred gives the chloride ion the best possible opportunity for deposition adjacent the junction. A clear stratification of the protrusions into regions exhibiting higher and lower chloride ion concentrations can in some instances be detected, but may not be detectable in every instance in which the preferred sequential halide addition is employed, since both bromide and iodide ions have the capability of displacing chloride to some extent from already precipitated silver chloride.

To preserve the structural integrity of the ultrathin tabular grains epitaxial deposition is preferably conducted under conditions that restrain solubilization of the halide forming the ultrathin tabular grains. For example, the minimum solubility of silver bromide at 60° C. occurs between a pBr of between 3 and 5, with pBr values in the range of from about 2.5 to 6.5 offering low silver bromide solubilities. Nevertheless, it is contemplated that to a limited degree, the halide in the silver salt epitaxy will be derived from the host ultrathin tabular grains. Thus, even when only chloride ion is introduced during epitaxial deposition, minor amounts of bromide and, in some instances, iodide will also be incorporated in the silver halide epitaxy.

Silver bromide epitaxy on silver chlorobromide host tabular grains has been demonstrated by Maskasky I as an example of epitaxially depositing a less soluble silver halide on a more soluble host and is therefore within the contemplation of the invention, although not a preferred arrangement.

Maskasky I discloses the epitaxial deposition of silver thiocyanate on host tabular grains. Silver thiocyanate epitaxy, like silver chloride, exhibits a significantly higher solubility than silver bromide, with or without minor amounts of chloride and/or iodide. An advantage of silver thiocyanate is that no separate site director is required to achieve deposition selectively at or near the edges and/or corners of the host ultrathin tabular grains. Maskasky U.S. Pat. No. 4,471,050, incorporated by reference and hereinafter referred to as Maskasky IV, includes silver thiocyanate epitaxy among various nonisomorphic silver salts that can be epitaxially deposited onto face centered cubic crystal lattice host silver halide grains. Other examples of self-directing nonisomorphic silver salts available for use as epitaxial silver salts in the practice of the invention include β phase silver iodide, γ phase silver iodide, silver phosphates (including meta- and pyro-phosphates) and silver carbonate.

It is generally accepted that selective site deposition of silver salt epitaxy onto host tabular grains improves sensitivity by reducing sensitization site competition for conduction band electrons released by photon absorption on image-wise exposure. Thus, epitaxy over a limited portion of the major faces of the ultrathin tabular grains is more efficient than that overlying all or most of the major faces, still better is epitaxy that is substantially confined to the edges of the host ultrathin tabular grains, with limited coverage of their major faces, and still more efficient is epitaxy that is confined at or near the corners or other discrete sites of the tabular grains. The spacing of the corners of the major faces of the host ultrathin tabular grains in itself reduces photoelectron competition sufficiently to allow near maximum sensitivities to be realized. Maskasky I teaches that slowing the rate of epitaxial deposition can reduce the number of epitaxial deposition sites on a host tabular grain. Yamashita et al U.S. Pat. No. 5,011,767, here incorporated by reference, carries this further and suggests specific spectral sensitizing dyes and conditions for producing a single epitaxial junction per host grain.

Silver salt epitaxy can by itself increase photographic speeds to levels comparable to those produced by substantially optimum chemical sensitization with sulfur and/or gold. Additional increases in photographic speed can be realized when the tabular grains with the silver salt epitaxy deposited thereon are additionally chemically sensitized with conventional middle chalcogen (i.e., sulfur, selenium or tellurium) sensitizers or noble metal (e.g., gold) sensitizers. A general summary of these conventional approaches to chemical sensitization that can be applied to silver salt epitaxy sensitizations are contained in *Research Disclosure*, Item 38957, Section III. Chemical sensitization. Kofron et al U.S. Pat. No. 4,439,520 illustrates the application of these sensitizations to tabular grain emulsions.

A specifically preferred approach to silver salt epitaxy sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetrasubstituted middle chalcogen ureas of the type disclosed by Herz et al U.S. Pat. Nos. 4,749,646 and 4,810,626, the disclosures of which are here incorporated by reference. Preferred compounds include those represented by the formula:

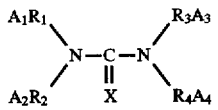

(V)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetrasubstituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^{+X-} \quad \text{(VI)}$$

wherein

L is a mesoionic compound;

X is an anion; and $L^1$ is a Lewis acid donor.

Kofron et al discloses advantages for "dye in the finish" sensitizations, which are those that introduce the spectral sensitizing dye into the emulsion prior to the heating step (finish) that results in chemical sensitization. Dye in the finish sensitizations are particularly advantageous in the practice of the present invention where spectral sensitizing dye is adsorbed to the surfaces of the tabular grains to act as a site director for silver salt epitaxial deposition. Maskasky I teaches the use of aggregating spectral sensitizing dyes, particularly green and red absorbing cyanine dyes, as site directors. These dyes are present in the emulsion prior to the chemical sensitizing finishing step. When the spectral sensitizing dye present in the finish is not relied upon as a site director for the silver salt epitaxy, a much broader range of spectral sensitizing dyes is available. The spectral sensitizing dyes disclosed by Kofron et al, particularly the blue spectral sensitizing dyes shown by structure and their longer methine chain analogs that exhibit absorption maxima in the green and red portions of the spectrum, are particularly preferred for incorporation in the ultrathin tabular grain emulsions of the invention. A more general summary of useful spectral sensitizing dyes is provided by *Research Disclosure*, December 1989, Item 38957, Section IV. Spectral sensitization and desensitization, A. Spectral sensitizing dyes.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an ultrathin tabular grain according to the invention after chemical sensitization has been completed.

Since ultrathin tabular grain emulsions exhibit significantly smaller mean grain volumes than thicker tabular grains of the same average ECD, native silver halide sensitivity in the blue region of the spectrum is lower for ultrathin tabular grains. Hence blue spectral sensitizing dyes improve photographic speed significantly, even when iodide levels in the ultrathin tabular grains are relatively high. At exposure wavelengths that are bathochromically shifted in relation to native silver halide absorption, ultrathin tabular grains depend almost exclusively upon the spectral sensitizing dye or dyes for photon capture. Hence, spectral sensitizing dyes with light absorption maxima at wavelengths longer than 430 nm (encompassing longer wavelength blue, green, red and/or infrared absorption maxima) adsorbed to the grain surfaces of the invention emulsions produce very large speed increases. This is in part attributable to relatively lower mean grain volumes and in part to the relatively higher mean grain surface areas available for spectral sensitizing dye adsorption.

Aside from the features of spectral sensitized, silver salt epitaxy sensitized ultrathin tabular grain emulsions described above, the emulsions of this invention and their preparation can take any desired conventional form. For example, although not essential, after a novel emulsion satisfying the requirements of the invention has been prepared, it can be blended with one or more other novel emulsions according to this invention or with any other conventional emulsion. Conventional emulsion blending is illustrated in *Research Disclosure*, Item 38957, Section I, Paragraph I, the disclosure of which is here incorporated by reference.

The emulsions once formed can be further prepared for photographic use by any convenient conventional technique. Additional conventional features are illustrated by *Research Disclosure* Item 38957, cited above, Section II, Emulsion washing; Section VI, Antifoggants and stabilizers; Section VII, Color materials; Section VIII, Absorbing and scattering materials; Section IX, Vehicles and vehicle extenders; X, Hardeners; XI, Coating aids; and XII, Plasticizers and lubricants; the disclosure of which is here incorporated by reference. The features of VII–XII can alternatively be provided in other photographic element layers.

The novel epitaxial silver salt sensitized ultrathin tabular grain emulsions of this invention can be employed in any otherwise conventional photographic element. Specific examples of photographic element constructions are provided by Kofron et al, cited above and here incorporated by reference; the ultrathin/epitaxy citations, here incorporated by reference above; Antoniades et al, cited above and here incorporated by reference; and *Research Disclosure*, Item 38957, Sections XI, Layers and layer arrangements, XII, Features applicable only to color negative, XIII, Features applicable only to color positive, and XIV, Scan facilitating features.

EXAMPLES

The invention can be better appreciated by reference to the following specific embodiments.

Emulsion A (A Comparative Emulsion)

Into a reaction vessel with good mixing was placed an aqueous gelatin solution (comprised of 1 liter of water, 10.0 g of oxidized bone gelatin, 4.17 mL of a 4N nitric acid solution, and 0.71 g of sodium bromide) and, while keeping the temperature thereof at 40° C. and a pAg of 9.41, 5.2 mL of an aqueous solution of silver nitrate (containing 4.42 g of silver nitrate) and 5.25 mL of an aqueous halide solution (containing 2.74 g of sodium bromide) were simultaneously added into the vessel over a period of 1 minute at a constant rate. Immediately afterwards, 3.25 mL of an aqueous halide solution (containing 1.70 g of sodium bromide) was added into the vessel at a constant rate over a period of 1.3 minutes. Thereafter, the temperature of the vessel was raised to 60° C. over a period of 12 minutes which was followed by a 9-minute hold with good mixing. Then, 6.67 mL of a 2.5N sodium hydroxide solution was added into the vessel over a period of 4 minutes. It was followed by the introduction of 178.1 mL of an aqueous silver nitrate solution (containing 151.3 g of silver nitrate) and 179.2 mL of an aqueous halide solution (containing 93.6 g of sodium bromide) at a constant rate over a period of 68.4 minutes.

Emulsion A thus made was a silver bromide ultrathin {111} tabular grain emulsion in which tabular grains accounted for >97% of total grain projected area. The mean ECD of the grains was 2.52 μm, mean tabular grain thickness was 0.0688 μm, and the COV of the grains was 54.6%.

Although an ultrathin tabular grain was prepared, the grain size dispersity was undesirably high.

Emulsion B (An Example)

The process of making Emulsion A was repeated, except that prior to precipitation, the vessel was added with PLURONIC-31R1™, a surfactant satisfying formula II, x=25, x'=25, y=7, at an amount equal to 36.3 wt % of silver introduced during nucleation.

Emulsion B thus made was a silver bromide ultrathin {111} tabular grain emulsion in which tabular grains accounted for >97% of total grain projected area. The mean ECD of the grains 0.96 μm, the mean thickness of the grains was 0.0669 μm, and the COV of the grains was 22.4%.

It is apparent that addition of the surfactant satisfying formula (II) reduced the grain size dispersity in the sought region of <25%.

Emulsion C (A Comparative Emulsion)

Into a reaction vessel with good mixing was placed an aqueous gelatin solution (comprised of 1 liter of water, 0.5 g of oxidized bone gelatin, 4.83 mL of 4N nitric acid solution, and 0.63 g of sodium bromide) and, while keeping the temperature thereof at 30° C. and a pAg of 9.82, 5.33 mL of an aqueous solution of silver nitrate (containing 0.45 g of silver nitrate) and an equal amount of an aqueous halide solution (containing 0.30 g of sodium bromide) were simultaneously added into the vessel over a period of 1 minute at a constant rate. Immediately afterwards, 19.2 mL of an aqueous halide solution (containing 1.97 g of sodium bromide) was added into the vessel after a 1-minute hold. Thereafter, the temperature of the vessel was raised to 60° C. over a period of 9 minutes followed by a 9-minute hold in good mixing. Gelatin solution (containing 16.7 g of oxidized bone gelatin) in the amount of 250 mL was subsequently added into the vessel followed by 8 mL of a 2.5N sodium hydroxide solution over a period of 2 minutes. Growth started with simultaneous introduction of 25 mL of an aqueous silver nitrate solution (containing 2.12 g of silver nitrate) and 25.5 mL of an aqueous halide solution (containing 1.42 g of sodium bromide) at a constant rate over a period of 10 minutes. Thereafter, 501.3 mL of an aqueous silver nitrate solution (containing 136.2 g of silver nitrate) and 496.3 mL of an aqueous halide solution (containing 85.5 g of sodium bromide) were added at a constant ramp over a period of 75 minutes starting from 1.72 mL/min and 1.77 mL/min, respectively. Subsequently, 235.8 mL of an aqueous silver nitrate solution (containing 64.1 g of silver nitrate) and 232.4 mL of an aqueous halide solution (containing 40.2 g of sodium bromide) were added into the vessel at constant rate over a period of 20.24 minutes.

Emulsion C thus made was a silver bromide ultrathin {111} tabular grain emulsion containing tabular grains accounting for >90% of total grain projected area mixed with rods. The mean ECD of the tabular grains was 2.03 μm, the mean thickness of the tabular grains was 0.050 μm, and the COV of the tabular grains 31.5%.

Although the mean COV of the total grain population was not measured, it would have been still higher than the mean COV of the tabular grains, which was already objectionably high.

Emulsion D (An Example)

The process of making Emulsion C was repeated, except that prior to precipitation, the vessel was added with PLURONIC-31R1™, a surfactant satisfying formula II, x=25, x'=25, y=7, at an amount equal to 7.9 wt % of silver introduced during nucleation.

Emulsion D thus made was a silver bromide ultrathin {111} tabular grain emulsion in which tabular grains accounted for >97% of total grain projected area. The emulsion was essentially free of rods. The emulsion grains exhibited a mean ECD of 1.93 μm, an average thickness of 0.0578 μm, and a COV of 20 percent.

This example demonstrates that the addition of the surfactant satisfying formula II lowered grain size dispersity without objectionably thickening the tabular grains.

Emulsion E (A Comparative Emulsion)

Into a reaction vessel with good mixing was placed an aqueous gelatin solution (composed of 1 liter of water, 0.5 g of oxidized bone gelatin, 4.83 mL of a 4N nitric acid solution, and 0.63 g of sodium bromide) and, while keeping the temperature thereof at 30° C. and a pAg of 9.82, 1.67 mL of an aqueous solution of silver nitrate (containing 0.14 g of silver nitrate) and equal amount of an aqueous halide solution (containing 0.09 g of sodium bromide) were simultaneously added into the vessel over a period of 1 minute at a constant rate. Immediately afterwards, 19.2 mL of an aqueous halide solution (containing 1.97 g of sodium bromide) was added into the vessel after a 1-minute hold. Thereafter, the temperature of the vessel was raised to 60° C. over a period of 9 minutes followed by a 9-minute hold in good mixing. Gelatin solution (containing 16.7 g of oxidized bone gelatin) in the amount of 250 mL was subsequently added into the vessel followed by 8 mL of a 2.5N sodium hydroxide solution over a period of 2 minutes. Growth started with simultaneous introduction of 25 mL of an aqueous silver nitrate solution (containing 2.12 g of silver nitrate) and 25.5 mL of an aqueous halide solution (containing 1.42 g of sodium bromide) at a constant rate over a period of 10 minutes. Thereafter, 501.3 mL of an aqueous silver nitrate solution (containing 136.2 g of silver nitrate) and 496.3 mL of an aqueous halide solution (containing 85.5 g of sodium bromide) were added at a constant ramp over a period of 75 minutes starting from 1.72 mL/min and 1.77 mL/min, respectively. Subsequently, 235.8 mL of an aqueous silver nitrate solution (containing 64.1 g of silver nitrate) and 232.4 mL of an aqueous halide solution (containing 40.2 g of sodium bromide) were added into the vessel at constant rate over a period of 20.24 minutes.

Emulsion E thus made was a silver bromide ultrathin tabular grain emulsion in which approximately 90% of total grain projected area was accounted for by tabular grains. The emulsion grains also contained a significant population of long rods. The mean ECD of the tabular grains 3.81 μm, the mean thickness of the tabular grains was 0.0628 μm, and the COV the tabular grains was 29.3%. The mean COV of the tabular grains was higher than desired for optimum grain size dispersity and the overall COV, based on all of the grains in the emulsion, though not measured, was clearly significantly higher.

Emulsion F (An Example)

The process of making Emulsion E was repeated, except that prior to precipitation, PLURONIC-31R1™, a surfactant satisfying formula II, x=25, x'=25, y=7, at an amount equal to 25.2 wt % of silver introduced during nucleation was added to the reaction vessel.

Emulsion F thus made was a silver bromide ultrathin {111} tabular grain emulsion. Tabular grains accounted for >97% of total grain projected area, and the grain population was essentially free of rods. The grains exhibited a mean ECD of 3.90 μm, a mean grain thickness of 0.0679 μm, and a COV of 19.6%.

This example demonstrates that the addition of the surfactant satisfying formula II lowered grain size dispersity without objectionably thickening the tabular grains.

Emulsion G (An Example)

The process of making Emulsion E was repeated, except that prior to precipitation, the vessel was added with PLURONIC-31R1™, a surfactant satisfying formula II, x=25, x'=25, y=7, at an amount equal to 15.7 wt % of silver introduced during nucleation. Furthermore, the silver nitrate solution and the halide solution introduced at 30 ° C. was increased by 60%.

Emulsion G thus made was a silver bromide {111} tabular grain emulsion in which tabular grains accounted for >97% of total grain projected area. The grain population was essentially free of rods. The mean ECD of the grains was 2.56 μm, mean grain thickness was 0.0653 μm, and total grain COV was 16.5%.

Emulsion H (An Example Emulsion)

This emulsion was prepared like Emulsion G, except that the amount of PLURONIC-31R1™ was doubled.

Emulsion H thus made was a silver bromide {111} tabular grain emulsion in which tabular grains accounted for >97% of total grain projected area. The grain population was essentially free of rods. The mean ECD of the grains was 2.93 μm, mean grain thickness was 0.065 μm, and total grain COV was 28%.

Emulsion I (A Comparative Emulsion)

Grain nucleation was carried out in an external nucleator of the continuous stirred-tank type. The nucleator was stabilized at 40° C. and pBr 2.3 with the following reactant flows: 100 mL/min of 0.4M $AgNO_3$, 100 mL/min of 0.47M NaBr (adjusted as needed to control pBr), and 1 mL/min of a gelatin solution containing 2.4 g/L oxidized gelatin at pH 4.5. The nucleator effluent was then diverted for 30 sec to a down-stream reactor containing 2 g/L oxidized gelatin. The down-stream reactor was initially at pBr 3.1, pH 4.5 and was maintained at 70° C. and at a constant volume of 13.5 L using ultrafiltration. At the end of this nucleation a NaBr solution was added to the down-stream reactor to change the pBr to 1.6. After 6 min, distilled water was slowly added to the down-stream reactor over a period of 10 min to gradually raise the pBr to 2.2 at 70° C.

The resulting nuclei were then grown as follows: A solution of 0.67M $AgNo_3$ was premixed with a 0.67M NaBr solution and a gelatin solution containing 4.8 g/L of oxidized gelatin (at 0.5 L/min) in the up-stream continuous stirred-tank reactor to form fine AgBr particles, and then added to the down-stream growth reactor where the fine particles dissolved to provide growth for the existing tabular nuclei. The silver reactant stream was linearly ramped from 20 L/min to 80 L/min over a period of 30 min, then from 80 L/min to 130 L/min over 30 min, then from 130 L/min to 150 L/min over 20 min. during this time the up-stream reactor for the generation of fine grains was maintained at 30° C. by adjusting the temperature of the gelatin stream and at pBr 2.6 by adjusting the flow of the haide stream. In addition, the down-stream growth reactor was maintained at 70° C. and at pBr 2.2 by the addition of a 2M NaBr solution. As previously, the volume of the down-stream growth reactor was maintained at a constant 13.5 L using ultrafiltration.

Following the dual-zone growth described above, the resulting ultrathin tabular grains were thickened by double jet precipitation, whereby a solution of 2M $AgNO_3$ was added at a linearly ramped rate of 43.5 to 53.6 mL/min while the pBr was controlled at 2.4 with a 2M NaBr solution. As with the previous growth process the temperature was maintained at 70° C. and the volume was maintained at a constant 13.5 L with ultrafiltration.

The resulting emulsion was washed with ultrafiltration.

Emulsion I thus made was a silver bromide {111} tabular grain emulsion in which tabular grains accounted for >97% of total grain projected area. The grain population was essentially free of rods. The mean ECD of the grains was 2.56 μm, mean grain thickness was 0.059 μm, and total grain COV was 22%.

Sensitometric Comparison

Samples of Emulsions H and I were each sensitized by the epitaxial deposition of 6 mole per cent silver halide per mole Ag of host emulsion onto the edges and corners of the host ultrathin grains according to the following procedure: pBr was adjusted to about 4 at 40° C. by balanced volume double jet addition of 0.05M silver nitrate and 0.006M potassium iodide solutions. Next, 0.005 mole/Ag mole of potassium iodide and 5.3 mL/Ag mole of 3.76M sodium chloride solution were added. Then a combination of the spectral sensitizing dyes D1 (anhydro-6,6'-dichloro-1,1'-diethyl-3,3'-bis(3-sulfopropyl)-5,5'-bis(trifluoromethyl) benzimidazolocarbocyanine hydroxide, sodium salt) and D2 (anhydro-5-dichloro-9-ethyl-5'-phenyl-3'(3-sulfobutyl)-3-(3-sulfopropyl) oxacarbocyanine hydroxide, triethylammonium salt) were added. For Emulsion I, the amounts of sensitizing dyes were 0.396 mmole/Ag mole D1 and 1.187 mmole/Ag mole D2. For Emulsion H, the amounts were 0.374 mmole/Ag mole D1 and 1.121 mmole/Ag mole D2. The small differences in dye levels for the two emulsions are proportional to the difference in the molar surface areas of the two emulsions in order that both emulsions are dyed at the same percent surface coverage of dye.

The dyed emulsion samples were held at 40° C. for 20 minutes, followed by additions of 0.25M NaCl and 0.25M KBr and AgI Lippmann seed emulsion in the added (nominal) molar proportion of Cl:Br:I of 0.42:0.42:0.16 to provide a total epitaxy summing to 6 mole % per Ag mole of host emulsion. These additions were followed by subsurface addition of 0.5M silver nitrate solution with stirring over 1 minute in an amount equimolar to the sum of bromide and chloride additions of this paragraph.

The emulsion samples were further sensitized with sodium thiocyanate (180 mg/Ag mole), 1,3-dicarboxymethyl-1,3-dimethyl-2-thiourea (10 μmole/Ag mole), and bis (1,3,5-trimethyl-1,2,4-triazolium-3-thiolate) gold(1) tetrafluoroborate (1.5 μmole/Ag mole). The antifoggant 1-(3-acetamidophenyl)-5-mercaptotetrazole (11.44 mg/Ag mole) was also added. Then the temperature was raised to 50° C. at a rate of 5° C. per 3 minute interval and held for 10 minutes before cooling to 40° C. at a rate of 6.6° C. per 3 minute interval. Then an additional 114.4 mg of 1-(3-acetamidophenyl)-5-mercaptotetrazole was added. The sensitized emulsion samples were coated on a cellulose acetate film support with an antihalation backing. The coatings contained 5.38 mg/dm$^2$ Ag, 21.53 mg/dm$^2$ gelatin, 9.69 mg/dm$^2$ cyan dye-forming coupler C1, 2 g/Ag mole 4-hydroxy-6-methyl-1,3,3a,7-tetraazaindene and surfactants. A protective overcoat containing hardener was also applied.

The dried coated samples were given 0.01 sec Wratten 9™ filtered daylight (5500° K.) exposures through a 21 step calibrated neutral density step tablet. The exposed samples were developed in the color negative Kodak Flexicolor™ C41 process. Speed was measured at a density 0.15 above minimum density and is reported in relative log units, 100 relative speed units=1.00 log E, where E represents exposure in lux-seconds. Contrast was measured as mid-scale contrast. The sensitometric results are given in the table below. Additional experimentation in which the levels of the sulfur, gold, and thiocyanate sensitizers were systematically varied showed that the results given in the Table were the optimum for each emulsion.

TABLE I

| Emulsion | Fog | Rel. Log Speed | Gamma |
|---|---|---|---|
| Emulsion I | 0.15 | 324 | 1.85 |
| Emulsion H | 0.08 | 331 | 1.92 |

From the data in Table I it is clear than when sensitized by a procedure that involves an epitaxial deposition of silver halide, the Example Emulsion H that was precipitated in the presence of the polyalkylene block copolymer gave much lower fog and higher speed and contrast (gamma) than comparative Emulsion I, which was precipitated according to the process disclosed in Antoniades et al.

Furthermore, in additional comparisons in which the levels of sulfur, gold, and thiocyanate sensitizers were varied, the sensitometric response of example Emulsion H changed hardly at all, while for comparative Emulsion I there were large decreases in speed and gamma, and especially large increases in fog. Thus the photographic performance of example Emulsion H was also much more robust than comparison Emulsion I. Robustness is an invaluable characteristic for possible commercial application, since it is not always possible in the manufacturing environment to eliminate all sources of inadvertent variations in the processes and materials. Finally, an emulsion precipitated according to the invention is more desirable for manufacturing than an emulsion precipitated according to Antoniades et al. The latter requires a more complex, dual zone reactor for precipitation.

The invention has been described in detail with particular reference to preferred embodiments thereof, but it will be understood that variations and modifications can be effected within the spirit and scope of the invention.

What is claimed is:

1. A photographic emulsion comprised of coprecipitated radiation-sensitive silver halide grains containing greater than 70 mole percent bromide, based on silver, and a dispersing medium wherein (a) the coprecipitated radiation-sensitive grains exhibit a coefficient of variation of less than 30 percent, (b) greater than 90 percent of total projected area of the coprecipitated radiation-sensitive silver halide is accounted for by grains which are tabular (1) having {111} major faces, (2) exhibiting a thickness of less than 0.07 μm, and (3) having latent image forming chemical sensitization sites on the surfaces of the tabular grains, the chemical sensitization sites including at least one silver salt epitaxially located on said tabular grains, and (c) the dispersing medium contains a grain dispersity reducing concentration of a polyalkylene oxide block copolymer surfactant comprised of two terminal lipophilic alkylene oxide block units linked by a hydrophilic alkylene oxide block unit accounting for from 4 to 96 percent of the molecular weight of the polymer.

2. A photographic emulsion according to claim 1 wherein the tabular grains account for greater than 97 percent of total grain projected area.

3. A photographic emulsion according to claim 1 wherein the coprecipitated grains contain less than 10 mole percent, based on silver, of each of chloride and iodide.

4. A photographic emulsion according to claim 3 wherein the coprecipitated grains contain less than 4 mole percent iodide, based on silver.

5. A photographic emulsion according to claim 4 wherein the coprecipitated grains are silver bromide or silver iodobromide grains.

6. A photographic emulsion according claim wherein the silver salt contains at least 10 mole percent chloride and at least one 1 mole percent iodide.

7. A photographic emulsion according to claim 6 wherein the silver salt contains a higher concentration of chloride and iodide than the tabular grains.

8. A photographic emulsion according to claim 7 wherein the silver salt additionally contains silver bromide.

9. A photographic emulsion according to claim 1 wherein the polyalkylene oxide block copolymer has a molecular weight of less than 16,000.

10. A photographic emulsion according to claim 1 wherein (a) the lipophilic alkylene oxide block units contain repeating units satisfying the formula:

$$-(\overset{\overset{\displaystyle R}{|}}{C}HCH_2O)-$$

where

R is a hydrocarbon of from 1 to 10 carbon atoms, and b) the hydrophilic alkylene oxide block unit is comprised of repeating units satisfying the formula:

$$-(\overset{\overset{\displaystyle R^1}{|}}{C}HCH_2O)-$$

where $R^1$ is hydrogen or a hydrocarbon of from 1 to 10 carbon atoms substituted with at least one polar group.

11. A photographic emulsion according to claim 7 wherein the polyalkylene oxide block copolymer has a molecular weight of from 760 to 16,000.

12. A photographic emulsion according to claim 1 wherein the dispersing medium contains a grain dispersity reducing concentration of a polyalkylene oxide block copolymer surfactant which satisfies the formula:

$$HO-(\overset{\overset{\displaystyle CH_3}{|}}{C}HCH_2O)_x-(CH_2CH_2O)_y-(\overset{\overset{\displaystyle CH_3}{|}}{C}H_2CHO)_{x'}-H$$

where x and x' are each in the range of from 6 to 120 and y is in the range of from 2 to 300, where the overall molecular weight of the polyalkylene oxide block copolymer is in the range of from 760 to 16,000.

* * * * *